United States Patent [19]

Kroeber

[11] Patent Number: 4,602,908

[45] Date of Patent: Jul. 29, 1986

[54] TOY BUILDING BLOCK SET

[76] Inventor: Lutz Kroeber, Abbachstrasse 24, Munich, Fed. Rep. of Germany, 8000

[21] Appl. No.: 562,595

[22] PCT Filed: Feb. 24, 1983

[86] PCT No.: PCT/EP83/00052

§ 371 Date: Oct. 21, 1983

§ 102(e) Date: Oct. 21, 1983

[87] PCT Pub. No.: WO83/03058

PCT Pub. Date: Sep. 15, 1983

[30] Foreign Application Priority Data

Jan. 3, 1982 [DE] Fed. Rep. of Germany ..... 3207253

[51] Int. Cl.[4] ..... A63H 33/08

[52] U.S. Cl. ..... 446/128; 446/124

[58] Field of Search ..... 446/108, 111, 112, 114, 446/115, 124, 125, 126, 128

[56] References Cited

U.S. PATENT DOCUMENTS

| | | | |
|---|---|---|---|
| 2,093,341 | 9/1937 | Reiche | 446/124 |
| 2,493,435 | 1/1950 | Archambault | 446/124 |
| 4,270,303 | 6/1981 | Xanthopoulos et al. | 446/115 |

FOREIGN PATENT DOCUMENTS

| | | | |
|---|---|---|---|
| 349363 | 4/1928 | Belgium . | |
| 1013553 | 8/1957 | Fed. Rep. of Germany . | |
| 1164295 | 2/1964 | Fed. Rep. of Germany | 446/128 |
| 926801 | 4/1947 | France . | |
| 994878 | 8/1951 | France . | |
| 1150976 | 1/1958 | France | 446/128 |
| 1264926 | 5/1961 | France | 446/128 |
| 1311992 | 11/1962 | France . | |
| 1401015 | 4/1965 | France . | |
| 589922 | 7/1947 | United Kingdom | 446/128 |
| 941040 | 11/1963 | United Kingdom | 446/128 |

*Primary Examiner*—Mickey Yu

*Attorney, Agent, or Firm*—Sandler & Greenblum

[57] ABSTRACT

The invention relates to a toy building block set comprising several plane blocks of various kinds. The building block set includes a cuboid panel block (1) having height h, width b and thickness d, an elongated beam block (2) with a square cross-section and length h and thickness d, and a trapezoid block (3) with thickness d, width of the tip nearly d, width of the base nearly b and length of a sloping side nearly h, the proportion of d:b:h being 1:3:4. The blocks, which are preferably made of synthetic material or wood, may be connected with each other by a peg and hole connection (4,5). The blocks may be used to construct very true-to-life and esthetically appealing structures.

6 Claims, 10 Drawing Figures

TRAPEZOID BLOCK 3
BEAM BLOCK 2
BEAM BLOCK 2'
BEAM BLOCK 2''
PANEL BLOCK 1
PANEL BLOCK 1

4R
R=d/2
b/2
h/2

TOY BUILDING BLOCK SET

BACKGROUND OF THE INVENTION

The present invention relates to a toy building block set comprising several blocks of various kinds.

Toy building block sets with building blocks which may be stuck together are often used by children to assemble simple structures or constructions. These toy building blocks are generally cuboid beam blocks of varying length which may be stuck together by a kind of nap or bristle connection The blocks may be stuck onto a base plate, for example, which supports the structure.

The number of structures which may be constructed with these blocks is limited; furthermore, the appearance of the finished structure often bears only slight resemblance to the original and thus fails to satisfy completely the esthetic sense of the playing child. This is due, among other things, to the following factors.

The known blocks can often be stuck together in only one preferred way, for example, so that no direct connections are possible between two blocks perpendicular to them; these may only be carried out by sticking a further block between them, which conflicts with a true-to-nature appearance.

Furthermore, arch-shaped structures such as gateways for example, can only be approximated by step-shaped right-angled constructions.

Connections at an angle which is not a right angle are generally impossible to carry out at all. Thus, no sloping surfaces such as roofs of houses may be put together with a conventional set of building blocks.

It is true that a great number of special blocks may be obtained for this kind of building block game which allow for connections other than right-angled ones, for example; but these special blocks can generally only be obtained as part of a building set for a specific model, such as a house, to be put together according to a plan, and are not intended to, and often cannot at all, be used for constructing other models or structures. These special blocks can thus only be used to construct the intended model in strict accordance with the predetermined plan, without the child requiring, or being stimulated to use, any imagination of his own.

Furthermore, if one of these special blocks is lost, the whole set is useless.

Ultimately, the child will resort to the normal cuboid blocks and use them to assemble constructions according to his imagination. Due to the above-mentioned limitation of the construction possibilities and the unsatisfying esthetic value of the constructed models, his interest in playing with the blocks will soon diminish.

The same is true of other sets of building blocks.

Adults also play with such building block sets in their free time, although for different reasons than children. For example, they are interested in constructing a certain imagined pattern, trying out possible combinations of block connections or building a structure in the form of a puzzle. Thus the reason why adults play with the blocks is determined more by the intellect than in the case of children. At the same time, adults want to be satisfied esthetically, i.e. they want to obtain a result which is a harmonious, esthetically appealing structure. The incentive to play is of course increased when such structures can be obtained with only a small number of types of blocks, without requiring a number of special blocks. This intellectual incentive with all the possibilities suggested is not provided by known building block sets.

The invention is based on the problem of providing a building block set comprising only a small number of different types of blocks with which a great number of different model structures may be assembled; the assembled model should be able to resemble the natural model as closely as possible, on the one hand, and esthetic design of the model should be possible with the blocks, on the other. This problem is solved according to the invention by the features stated in the claim 1.

SUMMARY OF THE INVENTION

This toy building block set exhibits at least three types of plane blocks serving as basic blocks and having the same thickness d, namely a plane cuboid panel block with height h, width b and thickness d, an elongated beam or connecting block with a square cross-section with length h and the sides of the square corresponding to value db, and a trapezoid block with thickness d, base width nearly b, tip width nearly b and sloping sides with a length of nearly h. The values of b, d and h are in a proportion of 1:3:4. Attractive dimensions for the blocks are achieved when $d=1$ cm, $b=3$ cm and $h=4$ cm.

The various blocks may be connected with each other by peg and hole connections on their sides as well as their tops and bottoms. The points of connection are arranged in a right-angled grid pattern, which yields many connecting possibilities. The grid interval of the grid pattern is selected as being d/2. Of course, not all surfaces of the blocks must be provided with a consistent grid pattern; a selection from this grid pattern also suffices. Thus, no connecting possibilities are provided for the trapezoid blocks on their front and rear sides, but only on the lateral sides and on the base and tip sides, since it has turned out that only these connections are necessary for structures. By way of contrast, the panel blocks exhibit connecting possibilities on all their surfaces; the beam blocks are provided with connecting possibilities on their elongated front and lateral sides, while the square tip sides do not necessarily have to have a connecting possibility. This all leads to many different connecting possibilities; in particular, right-angled connections are possible directly on one block connected with other blocks.

The above-mentioned three basic blocks may be added to by a further panel block with the same height and the same thickness but with half the width, and by a beam block which is also square but has half the length or height.

In the toy building block set according to the invention, the beam blocks are preferably designed as connecting blocks. They bear, at least on one longitudinal side, two connecting pegs at a certain distance apart symmetrically to the middle, which may be stuck in holes in other beam blocks or in panel blocks and trapezoid blocks for assembly. The other blocks thus exhibit only holes, which are arranged in the above-mentioned grid pattern matching the distance between the pegs. The peg distance preferably corresponds to half the height of the beam blocks.

Although the building block set according to the invention only exhibits three different kinds of blocks, it is possible to construct a great number of structures with it which are not only very similar to their natural models but are also constructed with a harmonious, esthetically satisfying design. Thus, these blocks may be used to produce, for example, arch-shaped structures by joining trapezoid blocks and connecting beam blocks, or connections at an angle by placing blocks on structures which already exist. This was previously impossible using known building block sets.

BRIEF DESCRIPTION OF THE DRAWINGS

Further embodiments and advantages of the invention may be found in the subclaims in combination with the following description, in which the invention is explained in more detail with reference to the drawings.

DETAILED DESCRIPTION OF THE DRAWINGS

Figures 1A, 1B, 1C, 1D, 1E, 1F:
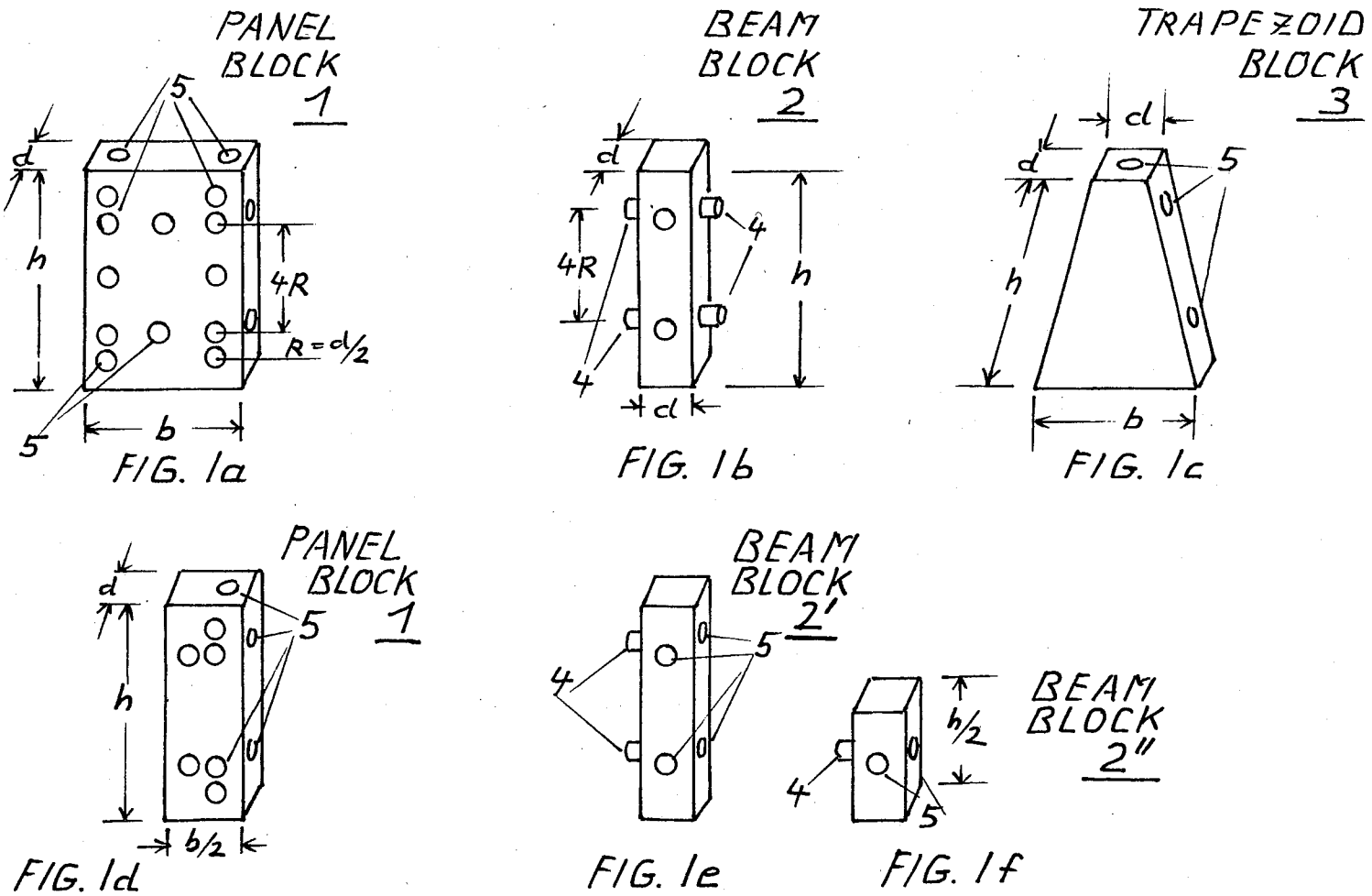
FIGS. 1*a* to *c* shows perspective views of a panel block, a beam or connecting block and a trapezoid block, respectively, for a toy building block set according to the invention.
FIGS. 1*d* to f shows perspective views of a further panel block and two further beam blocks, respectively.

FIG. 1 shows three types of blocks for a toy building block set: FIG. 1*a* a panel block 1 with thickness d, height h and width b, FIG. 1*b* a beam block 2 which functions as a connecting block and has width and thickness d and length h, and FIG. 1*c* a trapezoid block with the same thickness d, tip width nearly d and base width nearly b; the length of the sloping side corresponds approximately to dimension h. The ratio d:b:h corresponds to the ratio 1:3:4. Thickness d of the blocks is approximately 1 cm, so that b is about 3 cm and h about 4 cm. The blocks are preferably made of wood.

The beam block 2 shown in FIG. 1*b* functions as a connecting block and exhibits two connecting pegs 4 on each of two longitudinal sides opposite each other. These connecting pegs have a diameter of approximately 3 to 4 mm and protrude about the same distance out of the side of the block. The centers of the two connecting pegs are on the longitudinal center line of the longitudinal side symmetrical to its middle, and are at a distance of 2 cm from each other; thus, about 1 cm remains on each side towards the top and bottom edges of the block. In the same geometrical arrangement, the beam block exhibits two holes 5 on each of its two remaining sides. These holes have about the same diameter as pegs 4 and extend about the same distance into the block.

The panel blocks as in FIG. 1*a* exhibit on each of their sides holes 5 arranged in pairs and corresponding to connecting pegs 4 of the beam block. There are twelve holes 5 on the front of the panel block, with their centers arranged in three rows parallel to the longer edge with height h of the panel block. The two outer rows are each at a distance of about 0.5 cm from the side edges; the centers of the five holes are about 0.5 cm, 1 cm, 2 cm, 3 cm and 3.5 cm away from the lower edge of the panel block, respectively. The further row of holes running along the longitudinal center line of the front only includes two holes at a height of 1 cm and 3 cm, respectively. The hole arrangement described may be regarded as being a selection from a grid pattern extending across the entire front surface and having a grid interval R of 0.5 cm. The hole pattern on the back of the panel block may be the same as that on the front. Since the holes on the longitudinal and diagonal center line are not required as frequently for assembling models, these holes need not be provided on the back.

On the four remaining narrow sides of the panel block there are two holes each spaced equivalently to connecting pegs 4 and with their centers on the longitudinal center line symmetrically to its middle. If the beam block is stuck into the side shown on the right-hand side in FIG. 1*a*, for example, this beam block is connected flush with the panel block. If the beam block is stuck into the holes in the narrow side of the panel block shown on the top in FIG. 1*a*, the beam block, which is otherwise connected flush with the panel block, protrudes half a centimeter above the right-hand or left-hand upper edge of the panel block.

The trapezoid block shown in FIG. 1*c* only exhibits holes 5 on its narrow sides, i.e. on the base, the tip and the two lateral sides. Holes 5 are set in the sloping sides in such a way that the connected beam block lies directly with its side bearing connecting pegs 4 on the side of the trapezoid block. The base shown in FIG. 1*c* on the bottom with its width b of about 3 cm exhibits two holes in the same geometrical arrangement as on the narrow upper side of panel block 1. The tip of the trapezoid block only exhibits one hole in the center.

A great number of interesting models and patterns can be assembled with these three basic blocks.

The described building block set can be added to by the blocks shown in FIGS. 1*d* to 1*f*. FIG. 1*d* shows a panel block 1' corresponding to a panel block 1 with half its width, thus having width b/2. Height h and thickness d are unchanged. The holes 5 on the front, in this case seven, run in two rows, the centers of five holes being arranged as in panel block 1 along a row parallel to the longitudinal edge spaced about 0.5 cm apart. For similar reasons as mentioned above, it is possible to provide the middle holes of this row only on the front of panel block 1'. The two remaining holes 5 are arranged in such a way that the connecting pegs of a beam block 2 can be stuck into the front of the half-size panel block 1' so that the beam block is flush with the left-hand edge and the upper and lower edges of panel block 1'. The longer sides of the half-size panel block 1' each exhibit two holes 5 in the same geometrical arrangement as on the sides of panel block 1. On the narrow sides shown on the top and bottom in FIG. 1*b* there is only one hole spaced about 0.5 cm from the right-hand edge of block 1'.

FIG. 1*e* shows a variant 2' of beam block 2. This beam block 2' differs from that shown in FIG. 1*b* only in that it bears connecting pegs 4 only on one side whereas two other holes are provided instead of connecting pegs 4 on the opposite side. This kind of beam block 2' is often used as an end block.

FIG. 1*f* shows a further beam block 2'' corresponding to a beam block 2' as in FIG. 1*d* with half its length, and having the same arrangement of connecting pegs 4 and holes 5.

Figure 2:
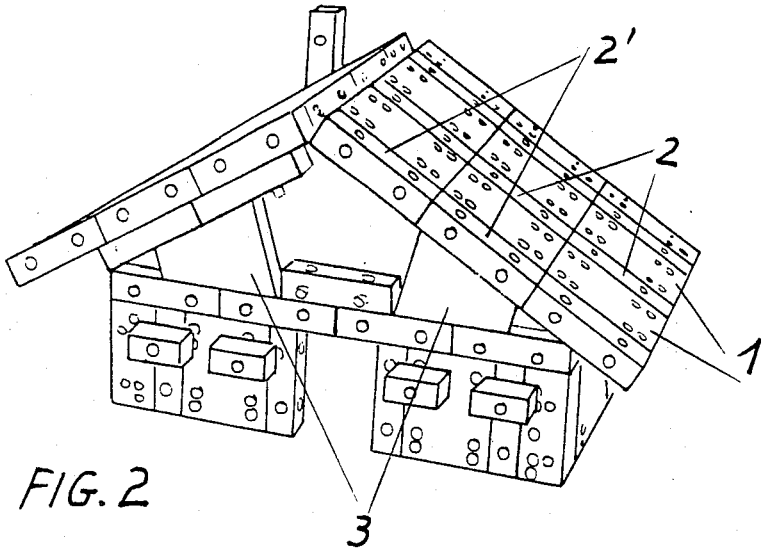
FIG. 2 illustrates a model of a house assembled with the blocks as in FIG. 1.

FIG. 2 shows a model of a house constructed with the described blocks. As may be seen in the figure, the sloping sides of the roof, for example, may be represented very faithfully by inserting trapezoid blocks. The roof of the model house is made of a combination of panel blocks and beam blocks. The beam blocks 2' serve as the end blocks at the front of the roof, whereas the beam blocks 2 each serve as a connecting block between two adjacent panel blocks 1. The half-size beam blocks 2'' are used to decorate the facade and may represent flower boxes, for example.

Figure 3:
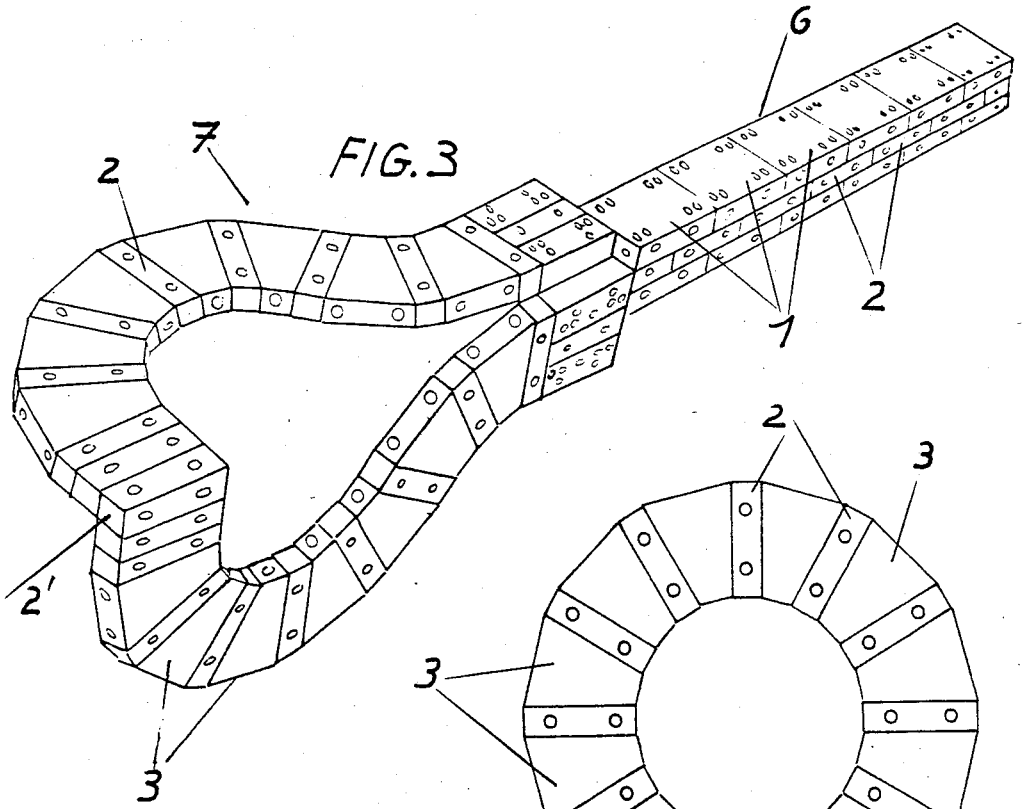
FIG. 3 illustrates a fanciful structure of blocks according to the invention.

FIG. 3 shows a fanciful structure comprising an arm 6 and a bent heart-shaped structure 7. Arm 6 is composed of panel blocks 1 and beam blocks 2, and the bent heart-shaped structure is made of trapezoid blocks 3 alternating with connecting blocks 2, with connecting blocks 2' at the bend. The transitional structure between the arm and the heart-shaped structure is constructed of half-size panel blocks 1' and connecting blocks 2. This fanciful structure clearly shows that right-angled connections are possible on one block, without the overall structure suffering any loss of harmony or esthetic value.

Figure 4:
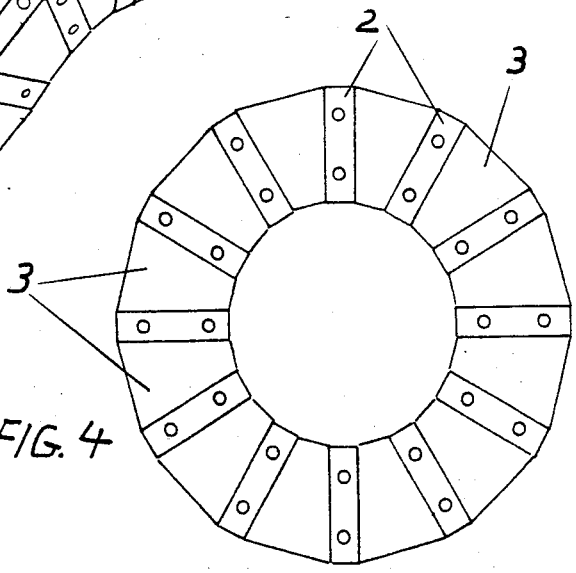
FIG. 4 illustrates a ring assembled with beam and trapezoid blocks.

FIG. 4 shows the model of a ring constructed of trapezoid blocks 3 alternating with connecting blocks 2. The ring shape corresponds very closely to the natural thing. Gates and other arched structures may be constructed in accordance with this example in an esthetically satisfying manner.

Figure 5:
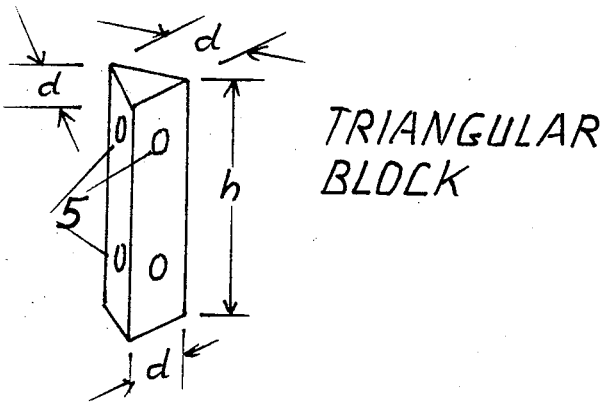
FIG. 5 illustrates a triangular block according to the invention.

An interesting extension of the building block set may be provided by introducing a block with height h and the cross-section of an equilateral triangle with side length d, as seen in FIG. 5. This block allows for connecting the other blocks edgewise to form round tubular shapes such as rollers, tunnels, etc. This greatly increases the multitude of possible forms even further. The appropriate pegs and holes for connecting to other blocks are of course also found on the sides of this triangular cross-section block.

I claim:

1. A toy building block set for building a plurality of different structures and designs consisting of a plurality of blocks in only three different shapes, said set comprising only the following blocks:

(a) at least one parallelepipedic panel block having a height to width to thickness ratio of 4:3:1 and having six sides;

(b) at least one parallelepipedic connecting block having a height to width to thickness ratio of 4:1:1, said height of said at least one parallelepipedic connecting block being substantially equal to said height of said at least one parallelepipedic panel block; and (c) at least one trapezoidal block comprising a tip, a base, two sloping sides connecting said tip and said base and two trapezoidal sides connecting said tip and said base; said at least one trapezoidal block having a thickness between said two trapezoidal sides which is substantially equal to the thickness of said at least one parallelepipedic panel block, said tip having a width which is substantially equal to the thickness of said at least one parallelepipedic panel block, said base having a width which is substantially equal to the width of said at least one parallelepipedic panel block, and each of said two sloping sides having a length which is substantially equal to the height of said at least one parallelepipedic panel block, wherein said set further comprises attaching means on each said parallelepipedic panel block, on each said parallelepipedic connecting block, and on each said trapezoidal block for connecting said blocks into said plurality of different structures and designs.

2. The building block set according to claim 1 wherein said at least one parallelepipedic connecting block is adapted to be used to connect at least two of said blocks for building structures and designs comprised of a plurality of said blocks.

3. A toy building block set for building a plurality of structures and designs consisting of a plurality of blocks of only three different types, said set comprising only the following blocks:

(a) at least one panel block having a height to width to thickness ratio of 4:3:1 and having six surfaces, at least four of said six surfaces comprising a plurality of holes spaced apart from one another by a predetermined distance;

(b) at least one connecting block having a height to width to thickness ratio of 4:1:1 and having four sides and two ends, at least one side having a plurality of holes, at least one other side having a plurality of spaced pegs, and at least one end having one hole, wherein said height of said at least one connecting block is substantially equal to said height of said at least one panel block; and (c) at least one trapezoidal block comprising a tip, a base, two sloping sides connecting said tip and said base, and two trapezoidal sides; said at least one trapezoidal block having a thickness between said two trapezoidal sides which is substantially equal to the thickness of said at least one panel block, said tip having a width which is substantially equal to the thickness of said at least one panel block and at least one hole positioned in a center part of said tip, said base having a width which is substantially equal to the width of said at least one panel block, and each of said two sloping sides having a length which is substantially equal to the height of said at least one panel block, and each of said base and said two sloping sides comprising a plurality of holes, wherein said holes are adapted to frictionally receive and retain said pegs and wherein none of said panel blocks nor said trapezoidal block have any pegs thereon.

4. The toy building block set according to claim 3 wherein said at least one connecting block is adapted to be used to connect at least two of said blocks for building structures and designs comprised of a plurality of said blocks.

5. The toy building block set according to claim 4 wherein said six surfaces of said at least one panel block comprise two ends, two narrow sides and two wide sides, said ends both comprising a plurality of spaced holes, at least two narrow sides comprising a plurality of spaced holes, and at least one of said two wide sides comprising a plurality of spaced holes.

6. The toy building block set according to claim 4 wherein said at least one connecting block has two sides having a plurality of spaced pegs.

* * * * *